US008360426B2

(12) United States Patent
Arikawa et al.

(10) Patent No.: US 8,360,426 B2
(45) Date of Patent: Jan. 29, 2013

(54) MEDIUM PRESSURIZING DEVICE AND IMAGE FORMING APPARATUS

(75) Inventors: Kiichirou Arikawa, Yokohama (JP); Shigeru Watanabe, Yokohama (JP); Yoshiro Konishi, Yokohama (JP); Yusuke Sato, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/109,465

(22) Filed: May 17, 2011

(65) Prior Publication Data

US 2012/0098191 A1 Apr. 26, 2012

(30) Foreign Application Priority Data

Oct. 26, 2010 (JP) ..... 2010-239365

(51) Int. Cl.
*B65H 5/02* (2006.01)

(52) U.S. Cl. ..... 271/273; 271/272; 271/274

(58) Field of Classification Search ..... 271/272, 271/273, 274, 207; 399/67, 332, 405
See application file for complete search history.

(56) References Cited

U.S. PATENT DOCUMENTS 4,110,068 A * 8/1978 Brown et al. ..... 432/60
5,140,378 A * 8/1992 Ibuchi et al. ..... 355/406
5,572,307 A * 11/1996 Tomatsu et al. ..... 399/122
7,200,356 B2 * 4/2007 Kawamoto ..... 399/405
7,448,623 B2 * 11/2008 Ahn et al. ..... 271/273
7,455,295 B2 * 11/2008 Marx et al. ..... 271/273
7,722,039 B2 * 5/2010 Shoji et al. ..... 271/273
7,894,734 B2 * 2/2011 Sawamura et al. ..... 399/67
7,942,411 B2 * 5/2011 Ishioka ..... 271/274
2006/0145416 A1 * 7/2006 Giese ..... 271/273
2007/0029725 A1 * 2/2007 Marx et al. ..... 271/272

FOREIGN PATENT DOCUMENTS

JP 2007-25571 A 2/2007

* cited by examiner

*Primary Examiner* — Kaitlin Joerger
(74) *Attorney, Agent, or Firm* — Sughrue Mion, PLLC

(57) ABSTRACT

A medium pressurizing device includes: two rotating bodies that rotate and allow a recording medium held in a contact part to pass; a pressurizing member that applies, to one of the rotating bodies, a pressure of pressing the one toward the other; a drive roll disposed downstream from the contact part in a conveyance direction, and rotating thereby transmitting a conveyance driving force to the recording medium; and a following roll contacting the drive roll, and rotating by following rotation of the drive roll, thereby conveying the recording medium held therebetween. The device further includes: an axis member rotating by receiving a driving force; and a cam member fixed to the axis member, acting on the pressurizing member, and following rotation of the axis member, thereby changing the pressure. The following roll has a hollow, and the axis member is disposed to pass through a space in the hollow.

5 Claims, 11 Drawing Sheets

MEDIUM PRESSURIZING DEVICE AND IMAGE FORMING APPARATUS

CROSS-REFERENCE TO RELATED APPLICATION

This application is based on and claims priority under 35 USC 119 from Japanese Patent Application No. 2010-239365, filed Oct. 26, 2010.

BACKGROUND

(i) Technical Field

The present invention relates to a medium pressurizing device and an image forming apparatus.

SUMMARY

According to an aspect of the invention, a medium pressurizing device includes a pair of rotating bodies, a pressurizing member, a drive roll, a following roll, an axis member and a cam member. The pair of rotating bodies rotate while forming a contact part in which the rotating bodies contact each other, and allow a recording medium to pass while holding the recording medium in the contact part. The pressurizing member applies, to one rotating body of the pair of rotating bodies, a pressure of pressing the one rotating body toward the other rotating body. The drive roll is disposed downstream from the contact part in a conveyance direction of conveying the recording medium, and rotates by receiving a driving force, to transmit a conveyance driving force to the recording medium. The following roll is disposed to contact the drive roll, and rotates by following rotation of the drive roll, to convey the recording medium while holding the recording medium between the drive roll and the following roll. The axis member rotates by receiving a driving force. The cam member is fixed to the axis member, acts on the pressurizing member, and follows rotation of the axis member to change the pressure of pressing the one rotating body toward the other rotating body. The following roll is formed to have a hollow inside, and the axis member is disposed to pass through a space formed in the hollow.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below with reference to the drawings.

Figure 1:
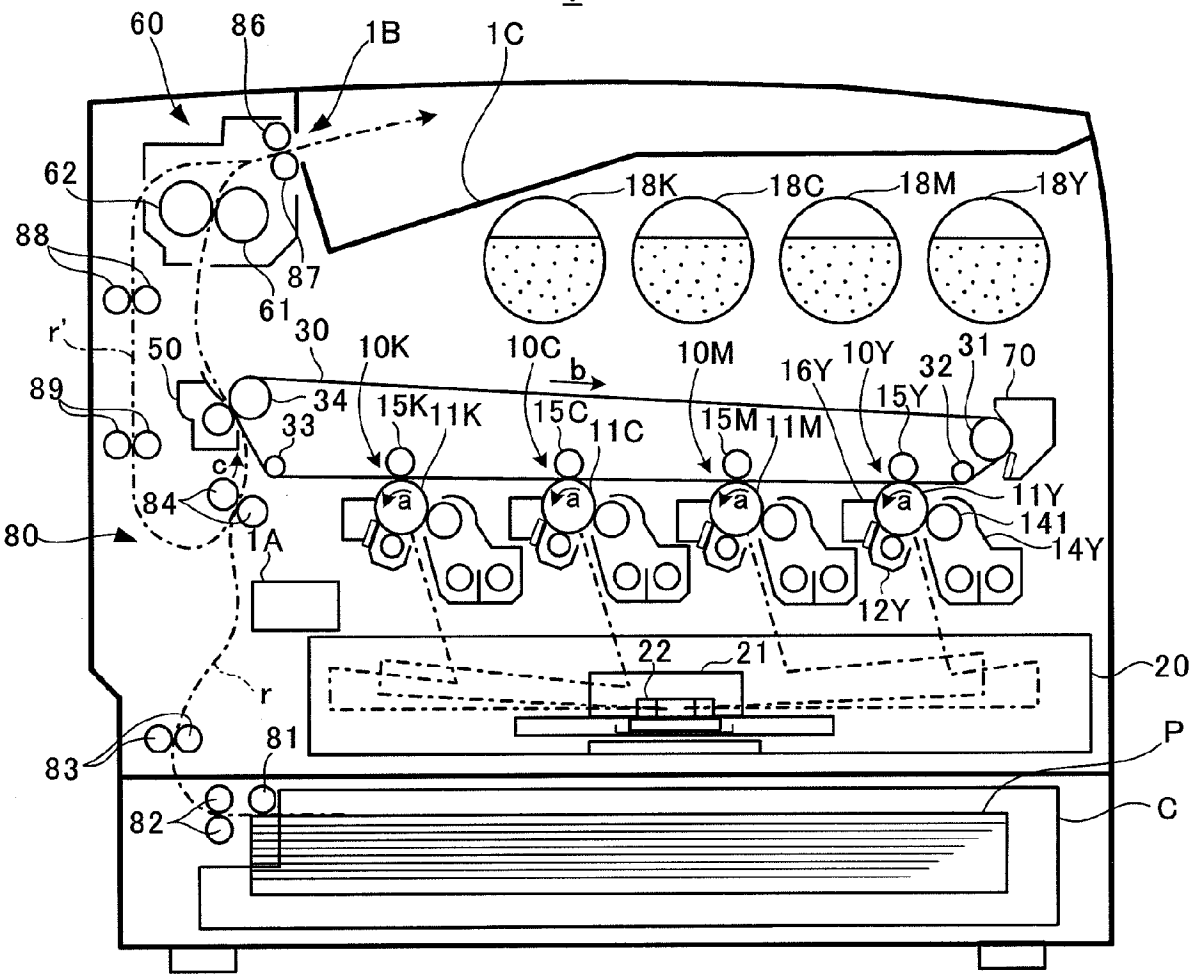
FIG. 1 is a block diagram that illustrates an exemplary embodiment of a image forming apparatus according to an aspect of the present invention.

FIG. 1 is a block diagram that illustrates an exemplary embodiment of the image forming apparatus according to an aspect of the present invention.

An image forming apparatus 1 illustrated in FIG. 1 is a tandem-type color printer in which image-forming sections 10Y, 10M, 10C and 10K are arranged in parallel for yellow (Y), magenta (M), cyan (C) and black (K), respectively. The image forming apparatus 1 is capable of printing a monochrome image as well as a full color image made up of toner images of four colors.

The image forming apparatus 1 includes: an exposure device 20 that irradiates each of the image-forming sections 10Y, 10M, 10C and 10K with exposure light; toner cartridges 18Y, 18M, 18C and 18K containing toners of CMYK colors, respectively; and an intermediate transfer belt 30 to which the toner images are transferred from the image-forming sections 10Y, 10M, 10C and 10K of the respective colors. The image forming apparatus 1 further includes: a secondary transfer device 50 that transfers the toner images from the intermediate transfer belt 30 to a sheet; a fixing device 60 that fixes the toner on the sheet; and a belt cleaner 70 that collects the toner from the intermediate transfer belt 30. The image forming apparatus 1 further includes: a sheet conveyance section 80 that conveys sheets; a sheet container C that houses the sheets; and a control section 1A that controls each part of the image forming apparatus 1.

The four image-forming sections 10Y, 10M, 10C and 10K have approximately the same configuration and thus will be described by taking the image-forming section 10Y corresponding to the yellow as a representative example. The image-forming section 10Y includes a photoreceptor 11Y, a charging device 12Y that charges a surface of the photoreceptor 11Y, a developing device 14Y that develops the surface of the photoreceptor 11Y with the charged toner after the exposure, a primary transfer device 15Y that transfers the toner image to the intermediate transfer belt 30, and a photoreceptor cleaner 16Y that cleans the surface of the photoreceptor 11Y. The photoreceptor 11Y has a cylindrical surface, carries the image formed on the surface, and rotates in a direction of an arrow a around the axis of a cylinder.

The exposure device 20 includes: a light-emitting device 21 that emits a laser beam based on an image signal supplied externally; and a polygon mirror 22 for scanning the photoreceptors 11Y, 11M, 11C and 11K with the laser beam emitted from the light-emitting device 21.

The intermediate transfer belt 30 is an endless belt-shaped member supported by belt support rolls 31, 32, 33 and 34, and circularly moves in a direction indicated by an arrow b by way of the image-forming sections 10Y, 10M, 10C and 10K and the secondary transfer device 50. The intermediate transfer belt 30 carries the toner images of the respective colors formed by the image-forming sections 10Y, 10M, 10C and 10K.

The secondary transfer device 50 is a roll that rotates while holding the intermediate transfer belt 30 and a sheet interposed between the secondary transfer device 50 and a backup roll 34 that is one of the belt support rolls 31 to 34. The secondary transfer device 50 transfers the toner images on the intermediate transfer belt 30 to the sheet. The belt cleaner 70 scrapes the toner on the intermediate transfer belt 30 with a blade by causing the blade to contact the intermediate transfer belt 30.

The fixing device 60 includes a heating roll 61 and a pressure roll 62, and fixes the toner images onto the sheet, by holding and allowing the sheet, on which the toner images yet to be fixed are formed, to pass through the fixing device 60.

The sheet conveyance section 80 extracts the sheet from the sheet container C and conveys the sheet along a sheet conveyance path r passing through the secondary transfer device 50 and the fixing device 60. The sheet conveyance section 80 includes a pickup roll 81 that takes out the sheets accommodated in the sheet container C, handling rolls 82 that handle the taken-out sheets, conveyance rolls 83 that convey the sheets, registration rolls 84 that convey the sheets to the secondary transfer device 50, ejection rolls 86 and 87 that eject the sheets to the outside, and reverse conveyance rolls 88 and 89 that convey the sheets in double-sided printing. The ejection rolls 86 and 87 are incorporated in the fixing device 60, and detachably attached to a main unit of the image forming apparatus 1, integrally with the fixing device 60.

Basic operation of the image forming apparatus 1 illustrated in FIG. 1 will be described. In the image-forming section 10Y of yellow, the photoreceptor 11Y is driven to rotate in the direction of the arrow a, and charge is applied to the surface of the photoreceptor 11Y by the charging device 12Y. This applies to the image-forming sections 10M, 10C and 10K corresponding to the colors other than yellow. The exposure device 20 irradiates each of the photoreceptors 11Y, 11M, 11C and 11K with the exposure light according to data corresponding to each color in the image signals. The description will be provided by taking yellow (Y) as a representative example here. The exposure device 20 forms an electrostatic latent image on the surface of the photoreceptor 11Y by irradiating the surface of the photoreceptor 11Y with the exposure light based on the image signal corresponding to yellow among the image signals supplied externally. The developing device 14Y forms the toner image by developing the electrostatic latent image with the toner of yellow. To the developing device 14Y, the toner is supplied from the toner cartridge 18Y. The photoreceptor 11Y rotates while carrying the toner image of yellow formed on the surface of the photoreceptor 11Y. The toner image formed on the surface of the photoreceptor 111 is transferred to the intermediate transfer belt 30 by the primary transfer device 15Y that applies a transfer bias potential between the surface of the photoreceptor 11Y and the intermediate transfer belt 30. After the transfer, the toner remaining on the photoreceptor 11Y is collected and removed by the photoreceptor cleaner 16Y.

The intermediate transfer belt 30 is circularly moved in a direction of an arrow b by the support rolls 31 to 34. The image-forming sections 10M, 10C and 10K corresponding to the colors other than yellow form the toner images corresponding to the respective colors in a manner similar to that in the image-forming section 10Y, and transfer the toner images to the intermediate transfer belt 30 to superimpose the toner images upon the toner image transferred by the image-forming section 10Y.

Meanwhile, a sheet P in the sheet container C is taken out by the pickup roll 81, and conveyed along the sheet conveyance path r by the handling rolls 82, the conveyance rolls 83 and the registration rolls 84, in the direction of an arrow c heading for the secondary transfer device 50. The sheet P is sent to the secondary transfer device 50 in timing for the transfer of the toner images onto the intermediate transfer belt 30 by the registration rolls 84. The secondary transfer device 50 transfers the toner images of the intermediate transfer belt 30 to the sheet, by applying a bias potential for transfer between the intermediate transfer belt 30 and the sheet. The sheet to which the toner images are transferred by the secondary transfer device 50 is conveyed to the fixing device 60 in which the toner images transferred onto the sheet are fixed. In this way, an image is formed on the sheet. The sheet on which the image is formed is ejected by the ejection rolls 86 and 87 from an ejection slot 1B onto an ejection supporter 1C provided in an upper part of the image forming apparatus 1. Meanwhile, after the transfer by the secondary transfer device 5, the toner remaining on the intermediate transfer belt 30 is removed by the belt cleaner 70.

In the case of double-sided printing in which an image is also formed on the back of the sheet having the image formed on the surface, the sheet is ejected by the ejection rolls 86 and 87 halfway and then conveyed in the reverse direction. The sheet conveyed in the reverse direction is conveyed by way of a reverse conveyance path r' by the reverse conveyance rolls 88 and 89. The conveyed sheet is sent into the secondary transfer device 50 in a state of being upside down from the registration rolls 84, and the image is formed on the back of the sheet as well.

[Fixing Device]

Here, the fixing device 60 of the image forming apparatus 1 illustrated in FIG. 1 will be described. The fixing device 60 is an exemplary embodiment of the medium pressurizing device according to an aspect of the present invention.

Figure 2:
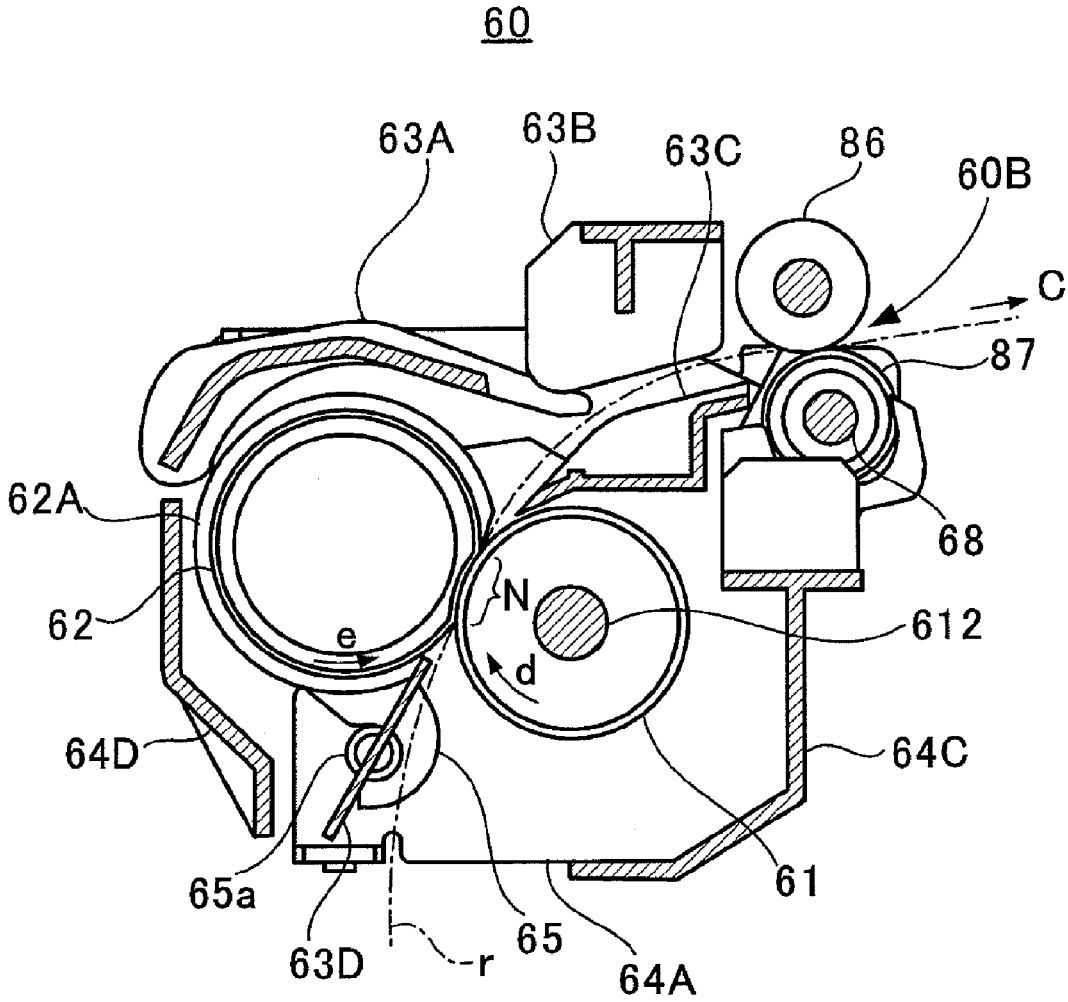
FIG. 2 is a cross-sectional diagram that illustrates a structure of the fixing device.

FIG. 2 is a cross-sectional diagram that illustrates a structure of the fixing device 60.

The fixing device 60 includes, sheet-guiding members 63A, 63B, 63C and 63D guiding the sheet and a support frame 64 (64A, 64B, 64C and 64D) supporting the structure of the fixing device 60, in addition to the heating roll 61, the pressure roll 62 and the ejection rolls 86 and 87. The support frame 64 includes: two roll support frames 64A and 64B that support each roll at the both ends; and two link frames 64C and 64D that extend along an axial direct ion X along the rotation shaft of each of the heating roll 61 and the pressure roll 62 (see FIG. 3), and are connected to the two roll support frames 64A and 64B, respectively. FIG. 2 illustrates the roll support frame 64A that is one of the two roll support frames 64A and 64B.

The heating roll 61 is a hollow cylindrical member in which a heat-resistant release layer is formed on a circumference surface of a cylindrical cored bar. A halogen lamp 612 serving as a heat source is provided inside the heating roll 61, and a peripheral surface of the heating roll 61 is heated by heat from the halogen lamp 612. The heating roll 61 is supported via a not-illustrated bearing member to be rotatable relative to the roll support frame 64A, and rotates in a direction of an arrow d by receiving a driving force transmitted from a not-illustrated drive motor.

The pressure roll 62 is a hollow cylindrical member in which an elastic layer made of, for example, rubber is formed on a circumference surface of a cylindrical cored bar. The pressure roll 62 is rotatably supported by a pressure lever 65 through a bearing member 62A.

Here, the heating roll 61 and the pressure roll 62 combined are equivalent to an example of the pair of rotating bodies according to an aspect of the present invention. In addition, the pressure lever 65 is equivalent to an example of the pressurizing member according to an aspect of the present invention.

Figure 3:
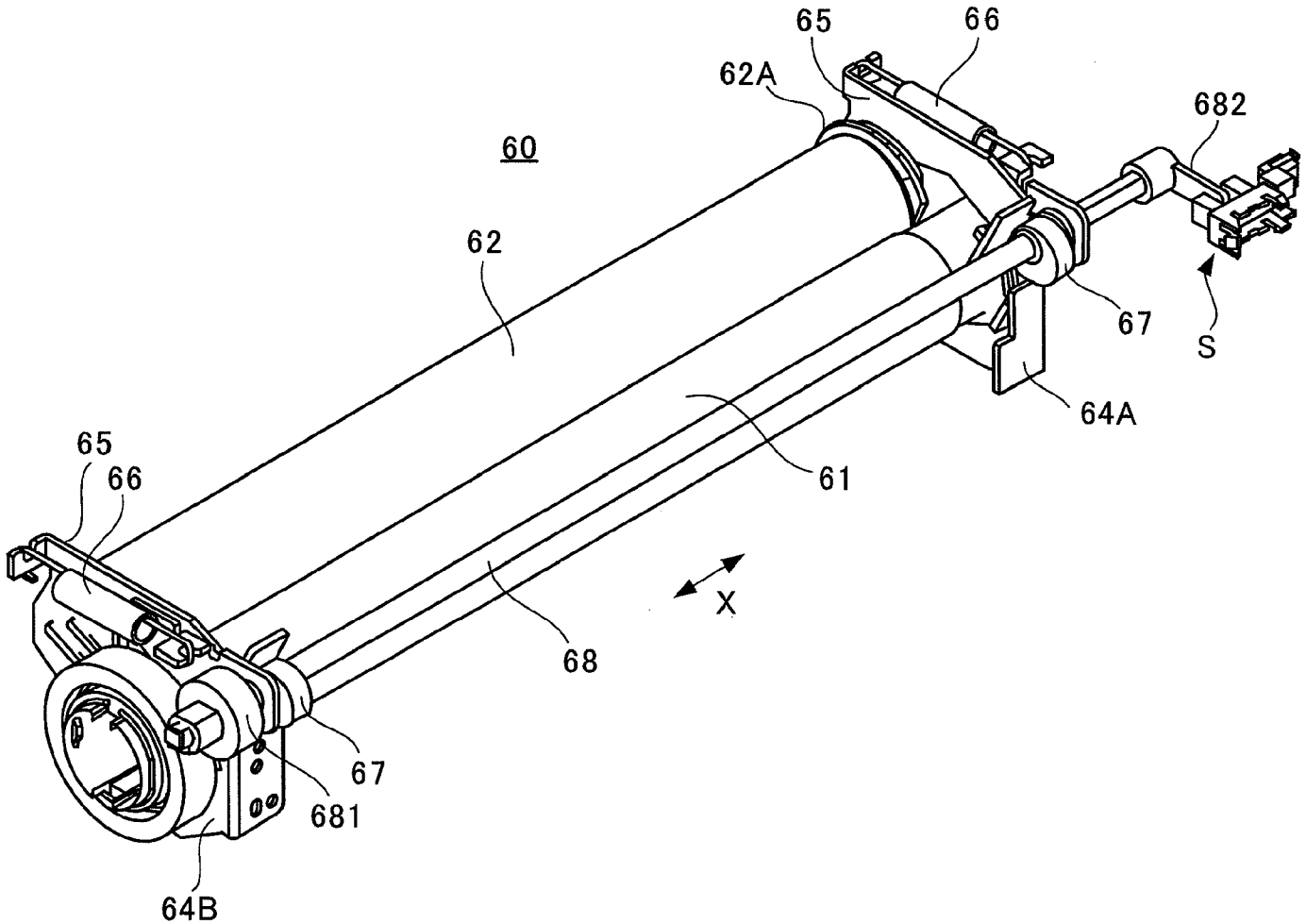
FIG. 3 is a perspective view of the fixing device illustrated in FIG. 2.

FIG. 3 is a perspective view of the fixing device illustrated in FIG. 2. FIG. 3 illustrates a structure in which the sheet-guiding members 63A to 63C, the link frames 64C and 64D, and the ejection rolls 86 and 87 are removed from the fixing device 60. The description will be continued below with reference to both of FIG. 2 and FIG. 3.

The roll support frames 64A and 64B that support the heating roll 61 are disposed at both ends of the heating roll 61 in the axial direction X. The pressure lever 65 also is disposed at each of both ends of the pressure roll 62 in the axial direction X, supports the pressure roll 62 at each of both ends in the axial direction X.

The pressure lever 65 is a member formed by, for example, cutting and bending a metal plate, and is supported to pivot about a rotation shaft 65*a* with respect to the support frames 64A and 64B. The pressure lever 65 pivots in a direction of pressing the pressure roll 62 against the heating roll 61 and thereby, a contact part N where the heating roll 61 and the pressure roll 62 contact each other is formed.

The heating roll 61 and the pressure roll 62 rotate in the direction indicated by the arrow d and a direction indicated by an arrow e, respectively, and allow the sheet to pass through while holding the sheet in the contact part N. The heating roll 61 and the pressure roll 62 applies heat to the toner images on the passing sheet under a pressure to be fused so as to fix the toner image on the sheet.

Between the pressure lever 65 and the support frames 64A and 64B, a spring 66 is installed. A force to press the pressure roll 62 against the heating roll 61 is applied by the spring 66 to the pressure lever 65 supported by the support frames 64A and 64B. In other words, the pressure to press the pressure roll 62 against the heating roll 61 is applied to the pressure roll 62 through the contact part N by the pressure lever 65.

Further, the fixing device 60 includes a pair of cam members 67 that rotate to press the pressure lever 65, and an axis member 68 to which these cam members 67 are fixed. The cam members 67 are made of, for example, a resin material, and the axis member 68 is made of, for example, a metallic material. As illustrated in FIG. 2, the axis member 68 extends by passing through a hollow of the ejection roll 87, and the axis member 68 does not contact the ejection roll 87. A supporting structure of the ejection roll 87 will be described later.

As illustrated in FIG. 3, the axis member 68 is supported at both ends in the axial direction X by the roll support frames 64A and 64B. The axis member 68 is a member that rotates by receiving a rotation driving force from a motor M1 (see FIG. 7), and has one end to which a gear 681 receiving the rotation driving force is fixed and the other end to which an angle indication piece 682 is fixed. The fixing device 60 is provided with a detector S that detects the angle indication piece 682 being at a reference position, and the detector S outputs a signal representing the result of the detection to the control section 1A (see FIG. 1). The control section 1A detects the rotation of the cam members 67 up to an angle of the reference position (home position), based on the signal from the detector S.

The cam members 67 rotate together with the axis member 68 and press the pressure lever 65, thereby changing the pressure to press the pressure roll 62 against the heating roll 61.

Figure 4:
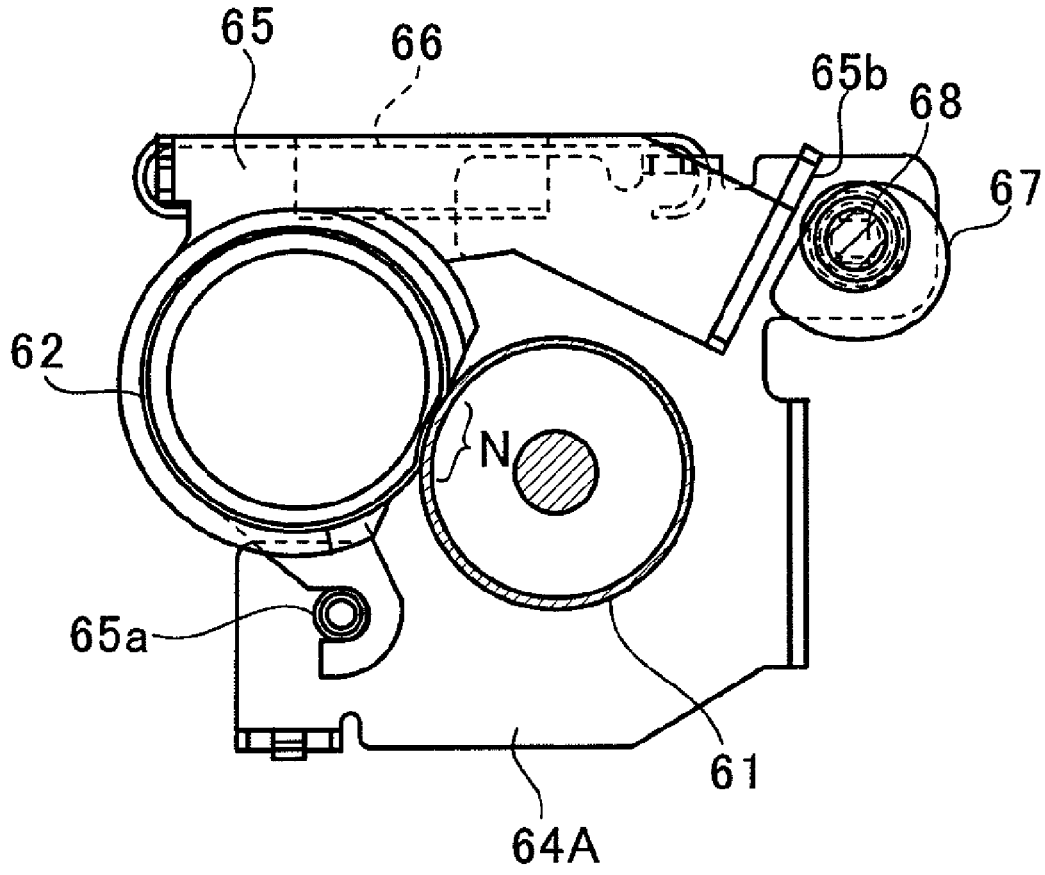
FIG. 4 is a diagram illustrating a normal pressurizing state.
Figure 5:
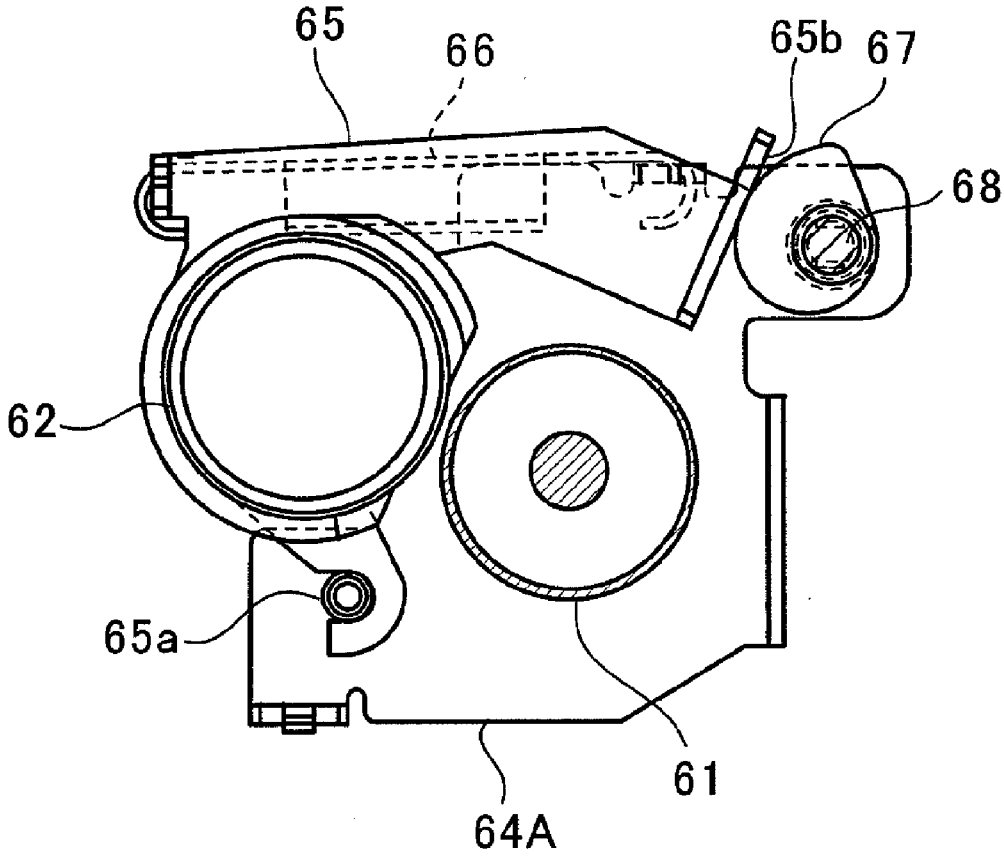
FIG. 5 is a diagram illustrating a pressure released state.

FIG. 4 and FIG. 5 are cross-sectional diagrams that illustrate the heating roll 61, the pressure roll 62, the pressure lever 65, the cam members 67 and the axis member 68 of the fixing device 60 illustrated in FIG. 2. FIG. 4 is a diagram illustrating a normal pressurizing state, and FIG. 5 is a diagram illustrating a pressure released state.

The normal pressurizing state illustrated in FIG. 4 is a state in which the image forming apparatus 1 forms the image on the sheet. In the normal pressurizing state, the cam members 67 are away from the pressure lever 65. In the normal pressurizing state, the pressure to press the pressure roll 62 against the heating roll 61 is applied to the pressure roll 62 by the pressure lever 65 due to an elastic force of the spring 66. The pressure roll 62 is elastically deformed by the pressing force, and a surface to hold the sheet at the contact part N is formed.

A shift from the normal pressurizing state illustrated in FIG. 4 to the pressure released state illustrated in FIG. 5 takes place, when the cam members 67 rotate and thereby the pressure roll 62 is separated from the heating roll 61 by the pressure lever 65. To be more specific, shifting operation occurs when the axis member 68 rotates by a predetermined angle upon receiving the rotation driving force from the not-illustrated motor based on the control of the control section 1A (see FIG. 1). The cam members 67 rotate together with the axis member 68, thereby pressing a cam follower 65*b* provided in the pressure lever 65, so that the pressure lever 65 is rotated around the rotation shaft 65*a* against the pressure applied by the spring 66. As a result, the pressure roll 62 is separated from the heating roll 61.

The pressure released state illustrated in FIG. 5 is a state for removing the sheet from the part between the pressure roll 62 and the heating roll 61 when, for example, jamming occurs. In the pressure released state, the heating roll 61 and the pressure roll 62 are separated from each other, and the pressure in the contact part N is released, so that the sheet is easily pulled out by hand.

When the cam members 67 in the pressure released state illustrated in FIG. 5 further rotate up to an angle at which the cam members 67 are separated from the pressure lever 65, the normal pressurizing state illustrated in FIG. 4 is obtained. When the cam members 67 are at the angle illustrated in FIG. 4, the angle indication piece 682 (FIG. 3) arrives at the position of the detector S. Based on the signal from the detector S, the control section 1A (see FIG. 1) stops the rotation of the cam members 67 at the reference position (home position), and thereby the normal pressurizing state illustrated in FIG. 4 is maintained.

[Ejection Rolls]

The ejection rolls 86 and 87 will be described by referring to FIG. 2 again. The ejection rolls 86 and 87 are disposed downstream from the contact part N in a conveyance direction c in which the sheet is conveyed. To be more specific, the ejection rolls 86 and 87 are disposed downstream from and next to the heating roll 61 and the pressure roll 62 in the conveyance direction c. Further, the roll support frames 64A and 64B, the link frames 64C and 64D and the sheet-guiding members 63A and 63B also function as a housing of the fixing device 60. Between the link frame 64C and the sheet-guiding member 63B, an ejection slot 60B of the fixing device 60 is formed. The fixing device 60 of the present exemplary embodiment is a device to subject the sheet to processing in the last stage, and the ejection slot 60B of the fixing device 60 is formed directly next to the ejection slot 1B of the image forming apparatus. The ejection rolls 86 and 87 are disposed closest to the ejection slot 60B among members to convey the sheet provided on the sheet conveyance path r, and convey and eject the sheet P from the ejection slot 60B.

Figure 6:
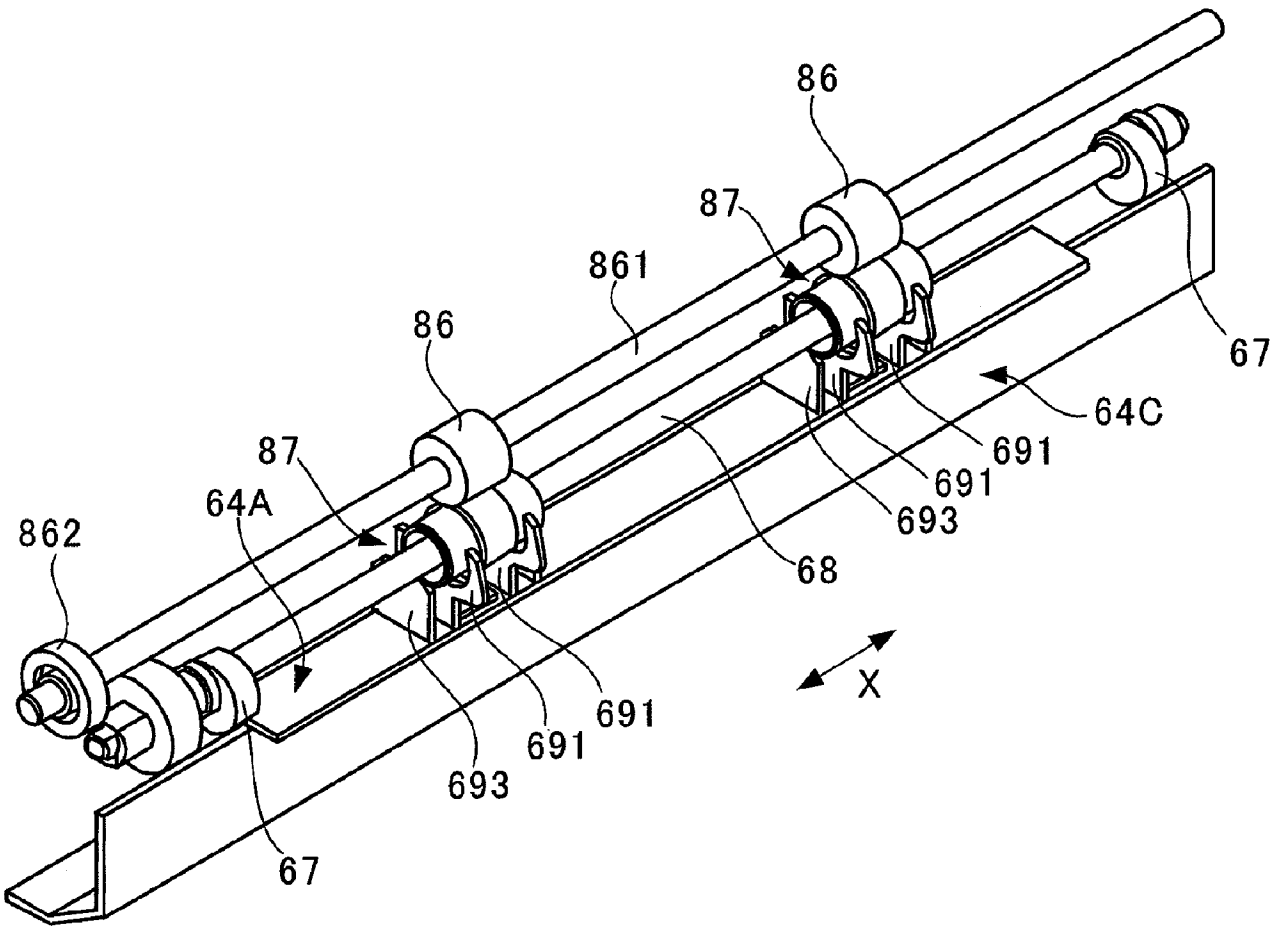
FIG. 6 is a perspective diagram that illustrates a support structure of ejection rolls.
Figure 7:
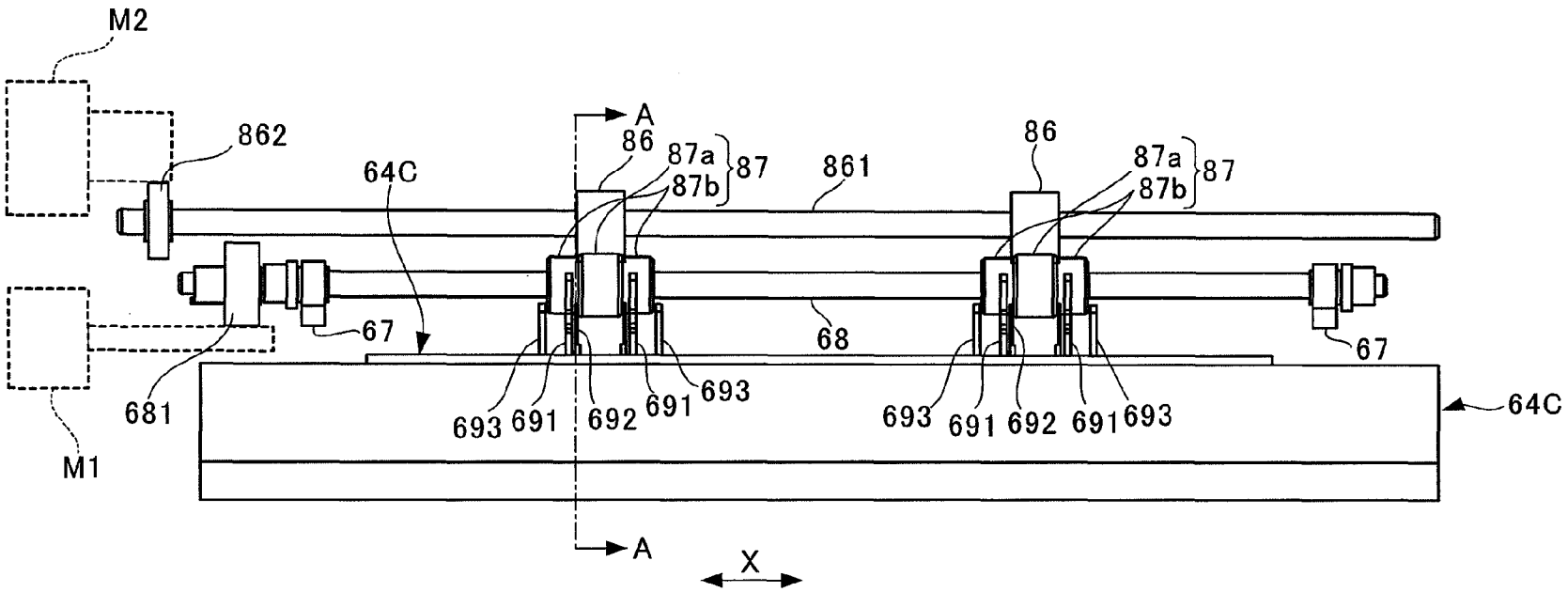
FIG. 7 is a diagram in which the support structure illustrated in FIG. 6 is viewed from the downstream side in the sheet conveyance direction.

FIG. 6 is a perspective diagram that illustrates a support structure of the ejection rolls 86 and 87. Further, FIG. 7 is a diagram in which the support structure illustrated in FIG. 6 is viewed from the downstream side in the sheet conveyance direction.

The ejection roll 86 is provided on the driving side, and the ejection roll 87 is driven by and follows the ejection roll 86 on the driving side. The pair of ejection rolls 86 and 87 will be hereinafter referred to as the driving-side ejection roll 86 and the driven-side ejection roll 87, respectively, to be distinguished from each other. The driven-side ejection roll 87 of the present exemplary embodiment is disposed on a lower side, namely, on the side corresponding to the image-formed surface of the sheet, like the heating roll (see FIG. 4), when viewed from the sheet. The driving-side ejection roll 86 of the present exemplary embodiment is disposed on an upper side, namely, on the side opposite to the side where the driven-side ejection roll 87 is disposed.

Here, the driving-side ejection roll 86 is equivalent to an example of the drive roll according to an aspect of the present invention, and the driven-side ejection roll 87 is equivalent to an example of the following roll according to an aspect of the present invention.

The driving-side ejection roll 86 is fixed to a rotation shaft 861, and supported by the support frame 64 via the rotation shaft 861. The ejection roll 86 and the rotation shaft 861 are made of, for example, a resin material. In the present exemplary embodiment, the two driving-side ejection rolls 86 are provided in the rotation shaft 861. Further, a gear 862 receiving the driving force from the motor M1 illustrated in FIG. 7 is fixed to one end of the rotation shaft 861.

In the present exemplary embodiment, the two driven-side ejection rolls 87 are provided to correspond to the two driving-side ejection rolls 86. Each of the driven-side ejection rolls 87 is approximately shaped like a cylinder having a hollow and made of, for example, a resin material, and includes a large diameter portion 87*a* having a large outer diameter, and a small diameter portion 87*b* provided on each of both sides of the large diameter portion 87*a* and having a small outer diameter. The driven-side ejection roll 87 contacts the driving-side ejection roll 86 at the large diameter portion 87*a*. FIG. 6 and FIG. 7 also illustrate the axis member 68 of the cam members 67, which extends while passing through the driven-side ejection rolls 87. However, the driven-side ejection rolls 87 are not supported by and do not even contact the axis member 68. Each of the driven-side ejection rolls 87 is supported on the link frame 64C by circumferential-surface pressing members 691, a spring 692 and displacement preventing members 693, which are disposed on an upper part of the link frame 64C. The link frame 64C has a T-shaped cross section and a flat surface formed on the top. The circumferential-surface pressing members 691 and the displacement preventing members 693 are provided to protrude upward from the flat surface of the link frame 64C. The circumferential-surface pressing members 691, the spring 692 and the displacement preventing members 693 contact the two small diameter portions 87*b* provided at the driven-side ejection roll 87.

Figure 8:
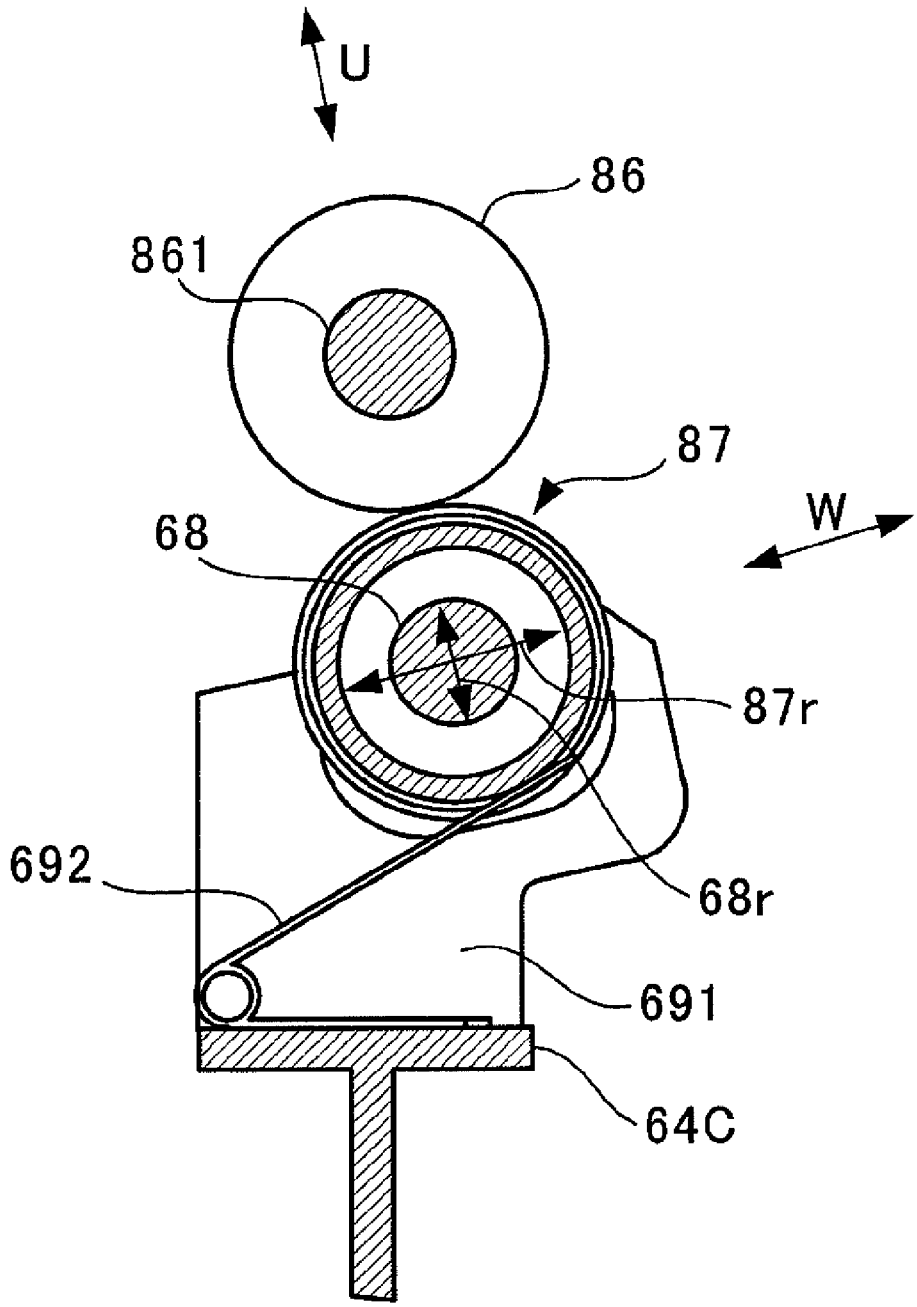
FIG. 8 is a cross-sectional diagram that illustrates a cross section of the support structure of the ejection rolls illustrated in FIG. 7, taken along a line A-A.

FIG. 8 is a cross-sectional diagram that illustrates a cross section of the support structure of the ejection rolls 86 and 87 illustrated in FIG. 7, taken along a line A-A.

Each of the circumferential-surface pressing members 691 has such a shape that a part on the side contacting the driven-side ejection roll 87 is bifurcated, and presses the driven-side ejection roll 87 with the bifurcated part. To be more specific, the circumferential-surface pressing member 691 presses the corresponding one of the two small diameter portions 87*b* at both sides in a direction W crossing both of a facing direction U in which the driving-side ejection roll 86 and the driven-side ejection roll 87 face each other and the axial direction X (see FIG. 6). This direction W is a direction in which the sheet is conveyed by the driving-side ejection roll 86 and the driven-side ejection roll 87, and will be hereinafter referred to as a conveyance direction W. The driven-side ejection roll 87 is prevented from moving in the conveyance direction W by the circumferential-surface pressing members 691, and supported to displaceable in the facing direction U.

The spring 692 is interposed between the driven-side ejection roll 87 and the link frame 64C, and presses the driven-side ejection roll 87, namely, both the two small diameter portions 87*b*, by repulsion, toward the driving-side ejection roll 86.

Figure 9:
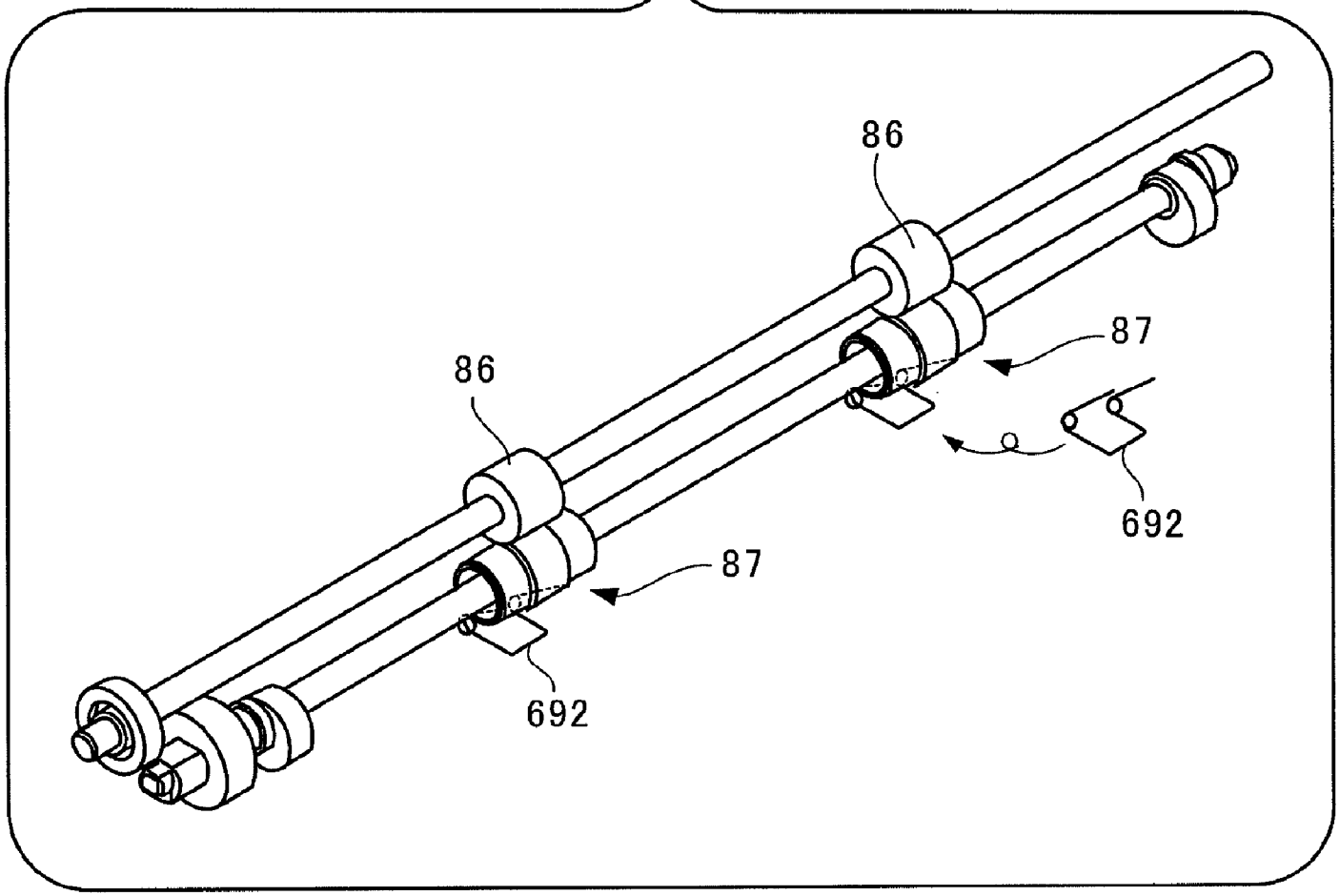
FIG. 9 is a perspective diagram that illustrates the ejection rolls and the spring 692 illustrated in FIG. 8.

FIG. 9 is a perspective diagram that illustrates the ejection rolls 86 and 87 and the spring 692 illustrated in FIG. 8. The spring 692 is formed by, for example, bending one steel wire, and has such a shape that two approximately V-shaped parts formed by linearly extending both ends of a coil spring and these parts are aligned and connected to each other. Due to this shape, the single spring 692 presses both of the two small diameter portions 87*b* of the driven-side ejection roll 87 in a stable posture without falling.

The displacement preventing members 693 illustrated in FIG. 6 and FIG. 7 contact the ends of the driven-side ejection roll 87 in the axial direction X, and presses the driven-side ejection roll 87 at the both ends in the axial direction X, thereby preventing the driven-side ejection roll 87 from moving in the axial direct ion X. In this way, the driven-side ejection roll 87 is supported in the link frame 64C by the circumferential-surface pressing members 691 and the displacement preventing members 693, and pressed toward the driving-side ejection roll 86 by the spring 692.

The driven-side ejection roll 87 supported by this support structure is allowed to rotate bidirectionally according to the driving force from the driving-side ejection roll 86. Thus, according to the rotation direction of a motor M2 (see FIG. 7) based on the control of the control section 1A, the driving-side ejection roll 86 and the driven-side ejection roll 87 rotate bidirectionally, and conveys the sheet in either of the direction to eject the sheet from the ejection slot 60B and the reverse direction.

The fixing device 60 of the present exemplary embodiment has such a structure that the axis member 68 of the cam members 67 passes through the follow of the driven-side ejection roll 87 as illustrated in FIG. 6, and the pressure exerted on the sheet by the pressure roll 62 and the heating roll 61 (see FIG. 2) is changed by the rotation of the cam members 67.

Here, in the case where a structure in which the axis member does not pass through the driven-side ejection rolls and is aligned with the ejection rolls is assumed, the cam members and the axis member are disposed downstream from the pressure roll 62 and the heating roll 61 along the direction in which the sheet passes, and the ejection rolls are disposed further downstream. Therefore, the cam members with the axis member and the ejection rolls are arranged approximately in series along the direction in which the sheet passes, increasing the size of the apparatus.

The fixing device 60 of the present exemplary embodiment has such a structure that the axis member 68 of the cam members 67 extends by passing through the hollows of the driven-side ejection rolls 87. Therefore, the cam members 67, the axis member 68 and the driven-side ejection rolls 87 are disposed downstream from the pressure roll 62 and the heating roll 61, at the same position in the direction in which the sheet passes. Therefore, as compared to the structure in which the axis member is provided separately from the ejection rolls, which is not the structure in which the axis member passes through the ejections roll, the size of the apparatus is reduced by the cam members and the axis member. Further, the fixing device 60 subjects the sheet to the processing in the last stage in the image forming apparatus 1 (see FIG. 1), and the pressure roll 62 and the heating roll 61 are disposed close to the ejection rolls 87. Therefore, the space occupied by these elements in the image forming apparatus 1 is reduced and thereby the entire image forming apparatus 1 also is reduced in size. The image forming apparatus 1 in which the fixing device 60 is disposed in the upper part as illustrated in FIG. 1 is low-profile, as compared to the structure in which the axis member is provided separately from the ejection rolls, which is not the structure in which the axis member passes through the ejections roll.

Further, in the present exemplary embodiment in the support structure, the driven-side ejection roll 87 is supported by the circumferential-surface pressing members 691 and the displacement preventing members 693 and pressed toward the driving-side ejection roll 86 by the spring 692. In this support structure, the driven-side ejection roll 87 and the driving-side ejection roll 86 form a space therebetween according to the thickness of the recording medium such as a sheet of cardboard and an envelope, and convey the recording medium smoothly.

Here, by referring to FIG. 8 again, a dimensional relation between the driven-side ejection roll 87 and the axis member 68 of the cam members 67 will be described. The driven-side ejection roll 87 has the hollow having a diameter 87*r* which is larger than a diameter determined by adding the maximum thickness of the recording medium that may pass between the driven-side ejection roll 87 and the driving-side ejection roll 86 to the outer diameter 68*r* of the axis member 68. For example, in a case where the maximum thickness of the recording medium which may pass, namely, the recording medium handled by the image forming apparatus 1 (FIG. 1) is 1 mm, the driven-side ejection roll 87 has the hollow of the diameter 87*r* larger than a diameter determined by adding 1 mm to the outer diameter 68*r* of the axis member 68. Thus, when a thick recording medium represented by a sheet of cardboard and an envelope passes, the driven-side ejection roll 87 moves (shifts) in the direction of leaving the driving-side ejection roll 86, resisting the force of the spring 692, without interfering with the axis member 68 passing through the driven-side ejection roll 87. Therefore, even when any of various kinds of recording media varying in thickness passes, the space is formed between the driven-side ejection roll 87 and the driving-side ejection roll 86, so that the recording medium is conveyed smoothly, without unintentionally interfering with the driven-side ejection roll 87 and the axis member 68.

[Conveyance and Reverse Conveyance of Sheet]

Here, the conveyance of the sheet by the two ejection rolls 86 and 87 that are the driven-side ejection roll 87 and the driving-side ejection roll 86 will be described.

Figure 10:
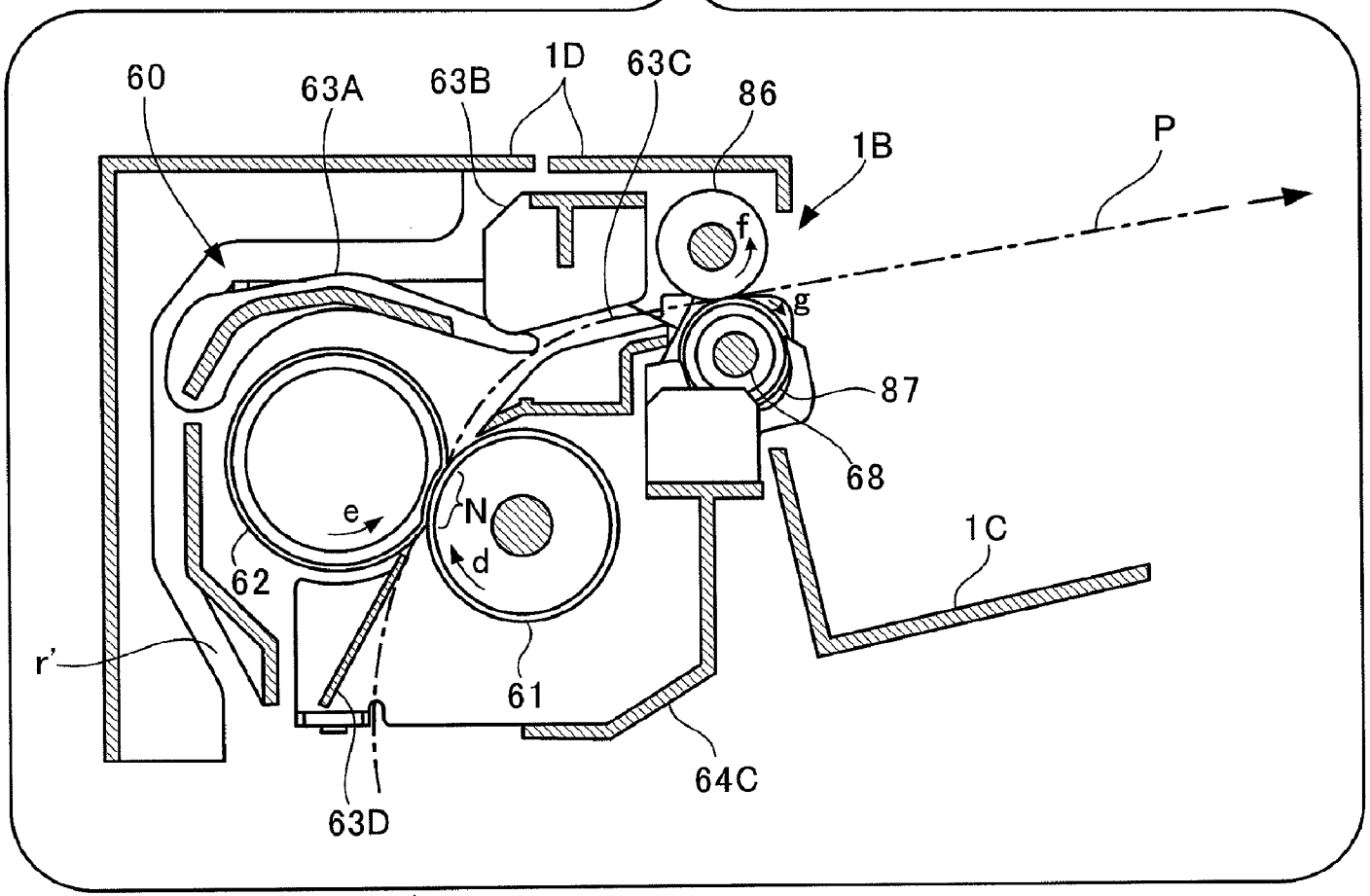
FIG. 10 is a cross-sectional diagram that illustrates the fixing device 60 and its peripheral part in the image forming apparatus illustrated in FIG. 1.

FIG. 10 is across-sectional diagram that illustrates the fixing device 60 and its peripheral part in the image forming apparatus 1 illustrated in FIG. 1. FIG. 10 also illustrates the ejection supporter 1C and a cover 1D covering the surroundings of the fixing device 60, of the image forming apparatus 1.

The heating roll 61 and the pressure roll 62 of the fixing device 60 rotate in the directions indicated by the arrows d and e, allow the sheet to pass while holding the sheet at the contact part N, and fix the toner images on the sheet. The ejection rolls 86 and 87 rotate in directions of arrows f and g while contacting each other, thereby ejecting the sheet P held therebetween from the ejection slot 1B. At the time, the sheet P is guided by the sheet-guiding members 63A to 63D and conveyed in the fixing device 60. Incidentally, among the sheet-guiding members 63A to 63D, the sheet-guiding member 63A disposed above the pressure roll 62 is pivotable about a fulcrum for changing the conveyance direction. When the sheet P is conveyed in the direction of being ejected form the ejection slot 1B, this sheet-guiding member 63A is lifted up by the sheet.

When jamming that stops the rotation in a state of the sheet P being held between the heating roll 61 and the pressure roll 62 occurs for some reason, as illustrated in FIG. 5, the cam members 67 rotate by following the rotation of the axis member 68, the pressure roll 62 is separated from the heating roll 61, and the pressure in the contact part N is released, so that the sheet P is easily pulled out by hand.

Figure 11:
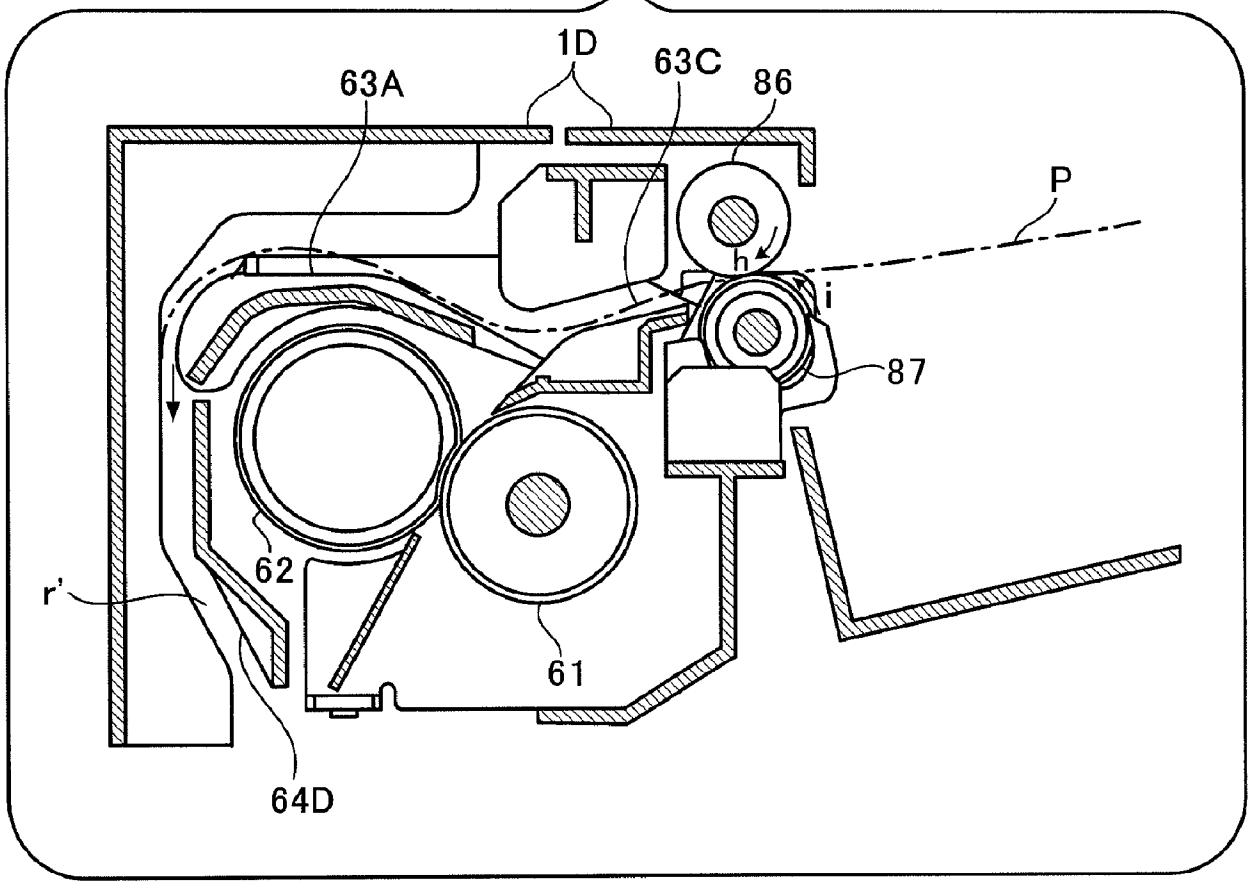
FIG. 11 is a diagram for explaining the reverse conveyance of the sheet.

FIG. 11 is a diagram for explaining the reverse conveyance of the sheet.

In the middle of the ejection of the sheet P, after the sheet P passes through the heating roll 61 and the pressure roll 62, the ejection rolls 86 and 87 convey the sheet P in the reverse direction, by rotating backward in directions indicated by arrows h and i after the rear end of the sheet P leaves the heating roll 61 and the pressure roll 62. At the time, the sheet-guiding member 63A pivots downward under the self weight, and the rotation is stopped by a not-illustrated stopper section of the sheet-guiding member 63C, and the sheet P is guided in the reverse conveyance path r' different from the path running between the heating roll 61 and the pressure roll 62. The sheet P is conveyed downward by passing along the reverse conveyance path r' provided between the cover 1D and the movable sheet-guiding member 63A as well as the link frames 64C and 64D.

Incidentally, in the exemplary embodiment, as an example of the medium pressurizing device according to an aspect of the present invention, the fixing device is taken. However, the medium pressurizing device may be a device pressurizing the recording medium, other than the fixing device. Further, in the exemplary embodiment, the heating roll 61 and the pressure roll 62 are taken as an example of the pair of rotating bodies according to an aspect of the present invention. However, the pair of rotating bodies are not limited to this example, and may be, for example, rolls that do not perform heating. Furthermore, the pair of rotating bodies are not limited to the rolls, and may be, for example, endless belts.

Furthermore, in the exemplary embodiment described above, the driving-side ejection roll 86 is taken as example of the drive roll according to an aspect of the present invention, and the driven-side ejection roll 87 is taken as an example of the following roll according to an aspect of the present invention. However, the drive roll and the following roll are not limited to the ejection rolls to eject the medium to the outside, and may be, for example, conveyance rolls disposed upstream from the ejection rolls. Moreover, in the exemplary embodiment, the example in which the driving-side ejection roll 86 and the driven-side ejection roll 87 are incorporated as part of the fixing device 60 is described. However, the present invention is not limited to this example, and the drive roll and the following roll may be incorporated in a device different from the medium pressurizing device.

Further, in the exemplary embodiment described above, the cam members 67 rotate between the normal pressurizing state and the pressure released state is taken as example of the cam member according to an aspect of the present invention. However, the cam member is not limited to this example, and may be, for example, positioned between the normal pressurizing state and the pressure released state according to the thickness of the recording medium, thereby causing a state in which the pressure is weaker than that in the normal pressurizing state.

Furthermore, in the exemplary embodiment, the tandem-type color printer is taken as example of the image forming apparatus according to an aspect of the present invention. However, the image forming apparatus is not limited to this example, and may be, for example, a printer dedicated to monochrome and having no intermediate transfer belt.

In the exemplary embodiment, the printer is taken as an example of the image forming apparatus according to an aspect of the present invention. However, the image forming apparatus is not limited to the printer and may be a copying machine or a facsimile that forms images based on data read by an image reader.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium pressurizing device comprising:

a pair of rotating bodies that rotate while forming a contact part in which the rotating bodies contact each other, and allow a recording medium to pass while holding the recording medium in the contact part;

a pressurizing member that applies, to one rotating body of the pair of rotating bodies, a pressure of pressing the one rotating body toward the other rotating body;

a drive roll that is disposed downstream from the contact part in a conveyance direction of conveying the recording medium, and rotates by receiving a driving force, to transmit a conveyance driving force to the recording medium;

a following roll that has a surface disposed to contact a surface of the drive roll, and rotates by following rotation of the drive roll, to convey the recording medium while holding the recording medium between the drive roll and the following roll; and an axis member that rotates by receiving a driving force;

a cam member that is fixed to the axis member, acts on the pressurizing member, and follows rotation of the axis member to change the pressure of pressing the one rotating body toward the other rotating body, wherein the following roll is formed to have a hollow inside, and the axis member is disposed to pass through a space formed in the hollow, and wherein the space formed in the hollow inside the following roll is larger than a diameter determined by adding a thickness of the recording medium having a maximum thickness among recording media to pass between the pair of rotating bodies to a diameter of the axis member.

2. The medium pressurizing device according to claim 1, further comprising:

a housing in which an ejection slot to eject the recording medium is formed, wherein the drive roll and the following roll are ejection rolls disposed near the ejection slot and eject the recording medium.

3. The medium pressurizing device according to claim 2, wherein the space formed in the hollow inside the following roll is larger than a diameter determined by adding a thickness of the recording medium having a maximum thickness among recording media to pass between the pair of rotating bodies to a diameter of the axis member.

4. An image forming apparatus comprising:

a pair of rotating bodies that rotate while forming a contact part in which the rotating bodies contact each other, and allow a recording medium in which an image is formed to pass while holding the recording medium in the contact part;

a pressurizing member that applies, to one rotating body of the pair of rotating bodies, a pressure of pressing the one rotating body toward the other rotating body;

a drive roll that is disposed downstream from the contact part in a conveyance direction of conveying the recording medium, and rotates by receiving a driving force, to transmit a conveyance driving force to the recording medium;

a following roll that has a surface disposed to contact a surface of the drive roll, and rotates by following rotation of the drive roll, to convey the recording medium while holding the recording medium between the drive roll and the following roll; and an axis member that rotates by receiving a driving force;

a cam member that is fixed to the axis member, acts on the pressurizing member, and follows rotation of the axis member, to change the pressure of pressing the one rotating body toward the other rotating body, wherein the following roll is formed to have a hollow inside, and the axis member is disposed to pass through a space formed in the hollow, and wherein the space formed in the hollow inside the following roll is larger than a diameter determined by adding a thickness of the recording medium having a maximum thickness among recording media to pass between the pair of rotating bodies to a diameter of the axis member.

5. A medium pressurizing device comprising:

a pair of rotating bodies that rotate while forming a contact part in which the rotating bodies contact each other, and allow a recording medium to pass while holding the recording medium in the contact part;

a pressurizing member that applies, to one rotating body of the pair of rotating bodies, a pressure of pressing the one rotating body toward the other rotating body;

a drive roll that is disposed downstream from the contact part in a conveyance direction of conveying the recording medium, and rotates by receiving a driving force, to transmit a conveyance driving force to the recording medium;

a following roll that has a surface disposed to contact a surface of the drive roll, and rotates by following rotation of the drive roll, to convey the recording medium while holding the recording medium between the drive roll and the following roll; and an axis member that rotates by receiving a driving force;

a cam member that is fixed to the axis member, acts on the pressurizing member, and follows rotation of the axis member to change the pressure of pressing the one rotating body toward the other rotating body, wherein the following roll is formed to have a hollow inside, and the axis member is disposed to pass through a space formed in the hollow, and wherein the space formed in the hollow inside the following roll is larger than a diameter, and a gap is formed between an outer surface of the axis member and an inner surface of the hollow inside.

* * * * *